US007551522B2

(12) United States Patent
Gruosi

(10) Patent No.: US 7,551,522 B2
(45) Date of Patent: Jun. 23, 2009

(54) WATCH MODULE COMPRISING A ROTARY DIAL CAPABLE OF BEING FITTED TO A WATCH MOVEMENT

(75) Inventor: Fawaz Gruosi, Prangins (CH)

(73) Assignee: De Grisogono SA (CH)

( * ) Notice: Subject to any disclaimer, the term of this patent is extended or adjusted under 35 U.S.C. 154(b) by 8 days.

(21) Appl. No.: 11/689,920

(22) Filed: Mar. 22, 2007

(65) Prior Publication Data

US 2007/0230287 A1 Oct. 4, 2007

(51) Int. Cl.
*G04B 19/00* (2006.01)
*G04B 19/20* (2006.01)
*G04B 19/06* (2006.01)

(52) U.S. Cl. ..... 368/223; 368/77; 368/220; 368/233

(58) Field of Classification Search ..... 368/223, 368/232, 233, 77, 220
See application file for complete search history.

(56) References Cited

U.S. PATENT DOCUMENTS 4,006,588 A * 2/1977 McMahon et al. ..... 368/233
4,206,592 A * 6/1980 Maue ..... 368/233
5,044,961 A * 9/1991 Bruskewitz ..... 434/304
5,088,440 A * 2/1992 Keaney ..... 116/298
5,638,341 A * 6/1997 Amano ..... 368/223
2003/0095475 A1 5/2003 Goldberg

FOREIGN PATENT DOCUMENTS

CH 338 782 5/1959
FR 2 626 985 8/1989

OTHER PUBLICATIONS

European Patent Office Search Report for EP 06 00 6515, dated Feb. 2, 2007.

* cited by examiner

*Primary Examiner*—Renee S Luebke
*Assistant Examiner*—Thanh S Phan
(74) *Attorney, Agent, or Firm*—Galbreath Law Offices, P.C.; John A. Galbreath

(57) ABSTRACT

A watch module comprising a rotary dial (1) possessing an opening (2) for displaying a complication or an image. This rotary dial (1) is mounted rotatably on a base dial (3) via an annular low-friction member (4). This rotary dial (1) can be pivoted through a certain angle by the action of a pusher (9, 9') to display another complication or image through the opening (2). This watch module, which comprises various parts (8, 13, 19, 21) for arresting and coupling the rotary dial (1) to the base dial (3), is arranged on the one hand in such a way as to decouple the rotary dial (1) from the base dial (3) when the pusher (9, 9') is pushed, and on the other hand to drive the rotary dial (1) when the pusher (9, 9') is released.

17 Claims, 6 Drawing Sheets

WATCH MODULE COMPRISING A ROTARY DIAL CAPABLE OF BEING FITTED TO A WATCH MOVEMENT

The present invention relates to horology, and more particularly to a watch module comprising a rotary dial capable of being fitted to a watch movement. The dial possesses an opening for displaying only one of the complications of the watch movement, the action of a pusher being used to pivot said dial in order to display another complication or an image.

BACKGROUND OF THE INVENTION

Most mechanical watches with so-called complicated work indicate other information than merely the time. Some complications such as the indication of a watch's power reserve, a perpetual calendar or the phases of the moon, for example, are put on the watch dial. Putting several complications into one watch can overload the dial and make the information difficult to read. Too much information can also detract from the dignity of the watch.

BRIEF SUMMARY OF THE INVENTION

It is an object of the present invention to provide a watch module comprising a rotary dial capable of being fitted to a watch movement, said rotary dial possessing an opening for displaying one type of information at a time in order both to facilitate the reading of the information and raise the tone of the watch.

In accordance with the invention, this object is achieved with a watch module comprising a rotary dial possessing an opening for displaying a complication. This rotary dial is mounted rotatably on a base dial via an annular low-friction member. Said rotary dial can be pivoted through a certain angle by the action of a pusher to display another complication or image through the opening. The decoupling of the rotary dial from the base dial preferably occurs when pressure is applied to the pusher, the rotation of the rotary dial being triggered when the pusher returns to its rest position.

BRIEF DESCRIPTION OF THE SEVERAL VIEWS OF THE DRAWING

The features of the invention will become clearer in the course of reading a description of one embodiment offered purely as a nonlimiting example, with reference to the diagrammatic figures, in which.

DETAILED DESCRIPTION OF THE INVENTION

Figure 1:
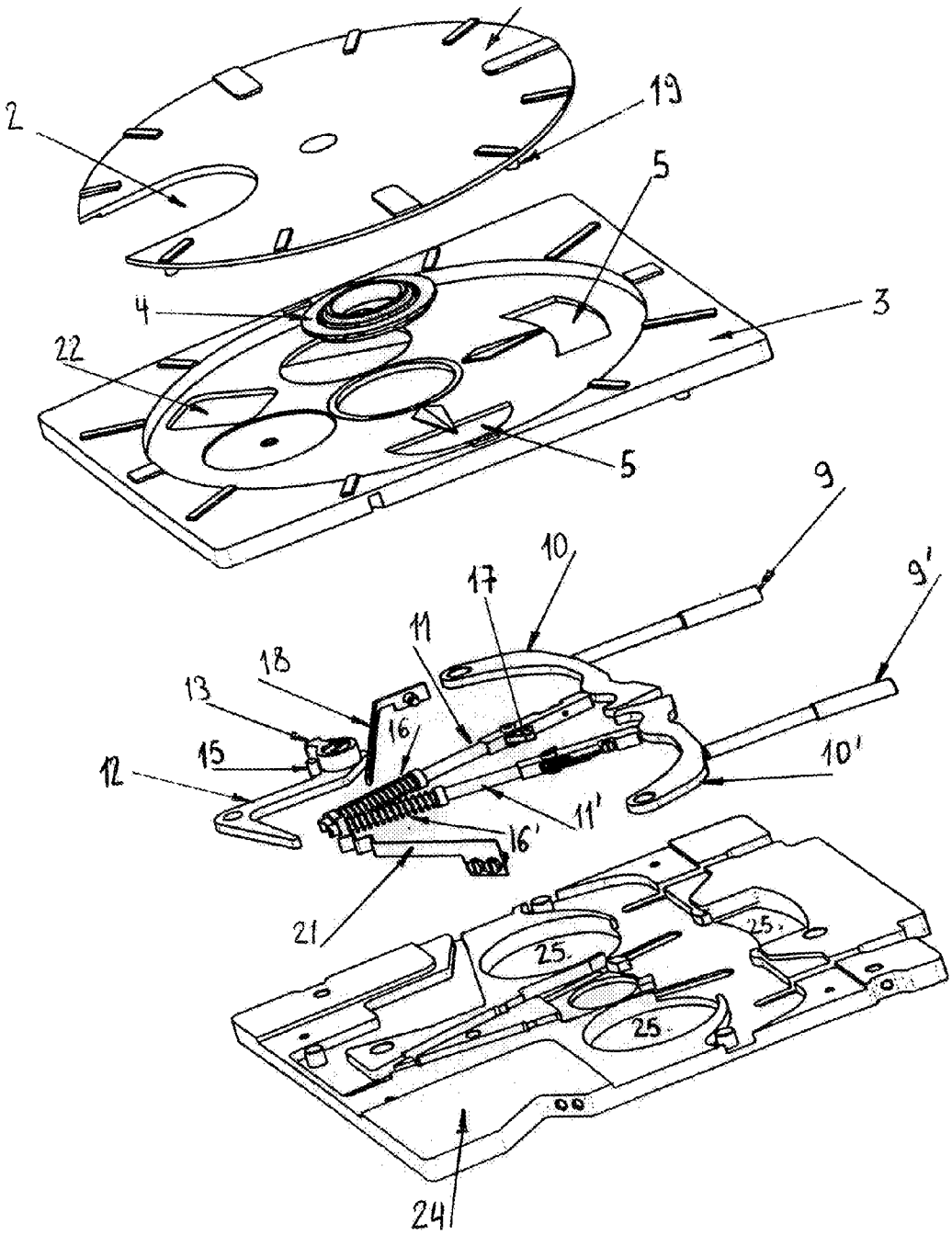
FIG. 1 is an exploded view of the watch module comprising the rotary dial, a base dial, two control systems and a plate.
Figure 2:
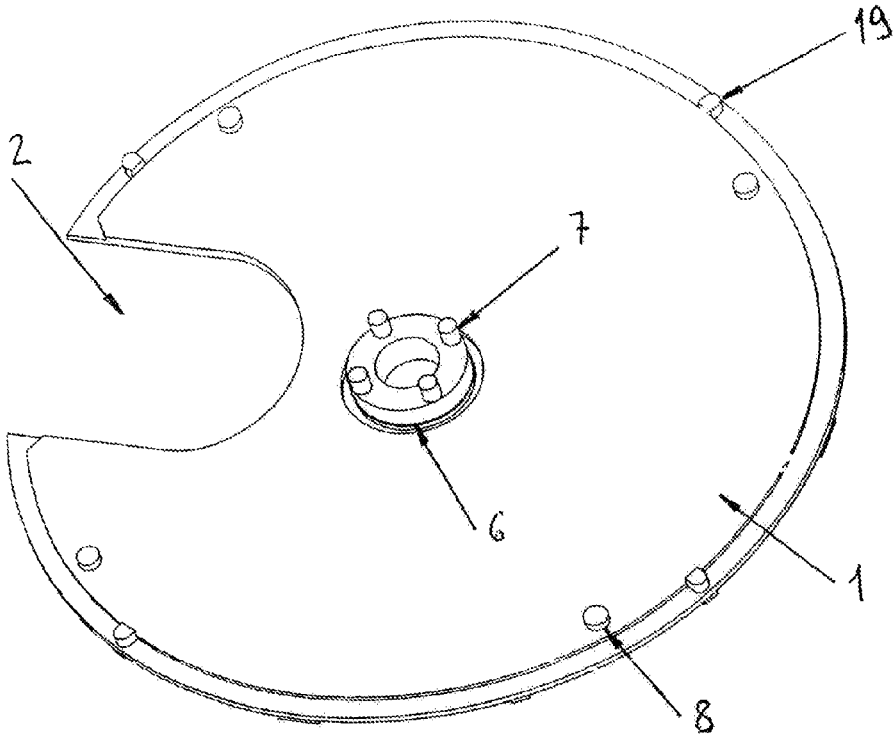
FIG. 2 is a bottom view of the rotary dial comprising four so-called driving pins, four so-called stop pins and four humps.

In the main embodiment of the present invention, the watch module comprises the rotary dial (1) which includes the opening (2). Said dial (1) is able to rotate on the base dial (3) via a ball bearing (4). The base dial (3) has four openings (5) each set out at 90° to allow four complications of the watch movement to be seen.

On the underside of the rotary dial (1) there are on the one hand an annular part (6) in its center, on which the four driving pins (7) are positioned at regular intervals, and on the other hand the other four stop pins (8) positioned around its periphery, also at regular intervals matching the driving pins (7).

Each of the four driving pins (7) is designed to be driven by an instantaneous mechanism, which will be described later, in order to turn the rotary dial (1) through 90° when a pusher (9, 9') is operated. Each of the stop pins (8) is designed to stop the rotary dial (1) turning once it has rotated through 90°.

Since the watch module has two identical control systems located symmetrically about the three o'clock/nine o'clock axis, one turning the rotary dial (1) clockwise and the other turning it counter clockwise, only the action of one of these systems will be described.

Figure 5:
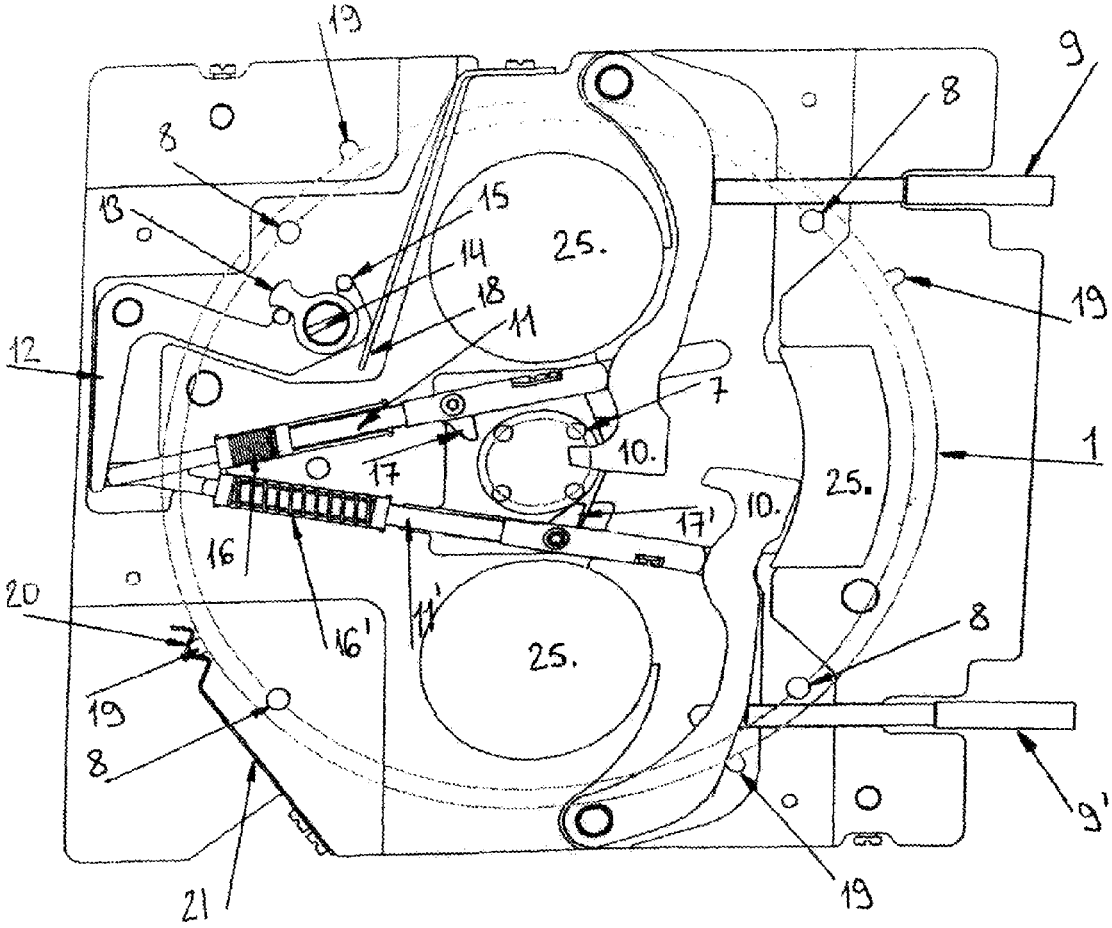
FIG. 5 is a top view of FIG. 4 when one of the pushers is operated and its control rod is at full stroke.
Figure 6:
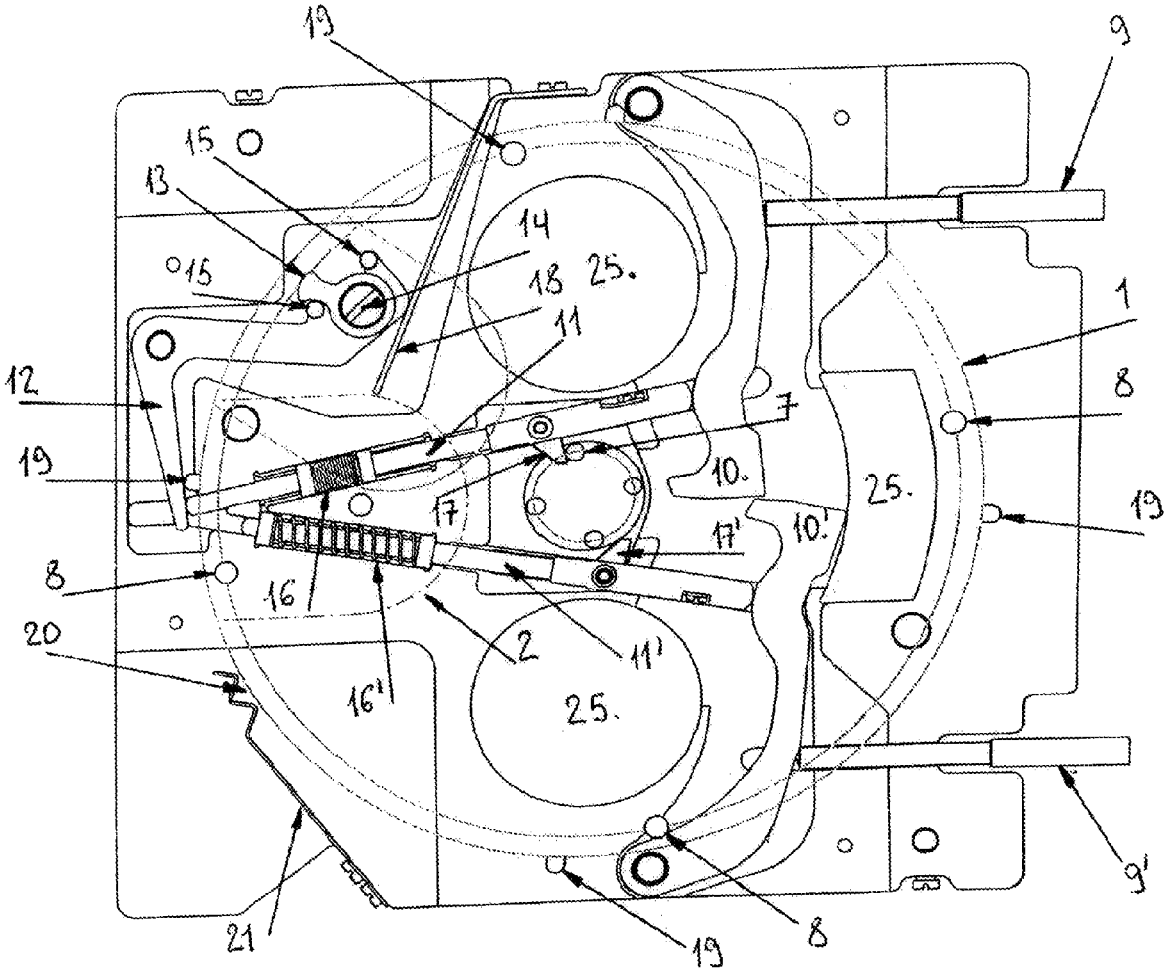
FIG. 6 is a top view of FIG. 5 when the rotary dial is rotating.

The control system, the purpose of which is to cause the rotary dial (1) of the module to pivot clockwise, comprises the following sequences:

- the pusher (9) operates a transmission rocker (10) that transmits a rectilinear movement to a rod (11) until one of its ends operates a so-called stop rocker (12);
- under the action of said rod (11), this rocker (12), which has a stop finger (13) that can pivot freely about a pivot pin (14) between two pins (15) that limit the movement of the finger (13), pivots in order momentarily to disengage the stop finger (13) from one of the stop pins (8) (FIG. 5);
- under the action of a return spring (16) arranged on the rod (11), the rod (11) is moved back in a straight line when the pusher (9) ceases to be operated, and this brings a hook (17) connected to the rod (11) into contact with one of the driving pins (7);
- as the return spring (16) continues to push, the hook (17) drives the driving pin (7), which causes the rotary dial (1) to rotate in a clockwise direction (FIG. 6);
- the rod (11) then returns to its rest position;
- at this point, under the action of a leaf spring (18), the stop rocker (12) has returned to its initial position, thus allowing the next stop pin (8) to be stopped by the stop finger (13) once the rotary dial (1) has pivoted through 90°.

When it is operated, the pusher (9) triggers an instantaneous rotation of the rotary dial (1) through the various sequences mentioned above. However, when one of the stop pins (8) is arrested by the stop finger (13), the rotary dial (1), having turned 90°, is now in an unstable position. To alleviate this problem, on the perimeter of the rotary dial (1) there are four humps (19) corresponding to the stop pins (8). The humps are designed to click one at a time into a housing (20) formed in a leaf spring (21) and thereby stabilize the rotary dial (1). This leaf spring (21) is mounted in a well (not shown) in the base dial (3).

The base dial (3) has an extra opening (22) (FIG. 1) at ten o'clock in order to position the finger (13) of the so-called stop rocker (12) at the stop pins (8).

Figure 3:
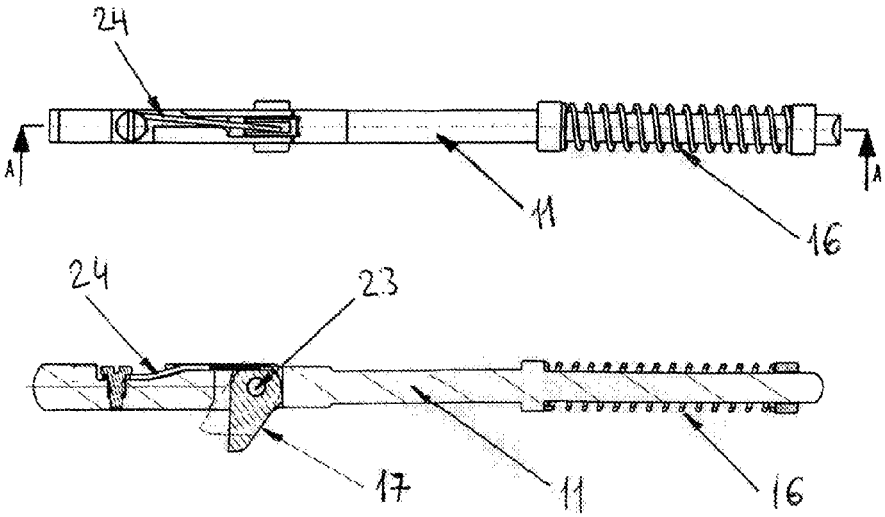
FIG. 3 is a rear view of a control rod comprising a hook and a cross section taken on A-A through said rod.
Figure 4:
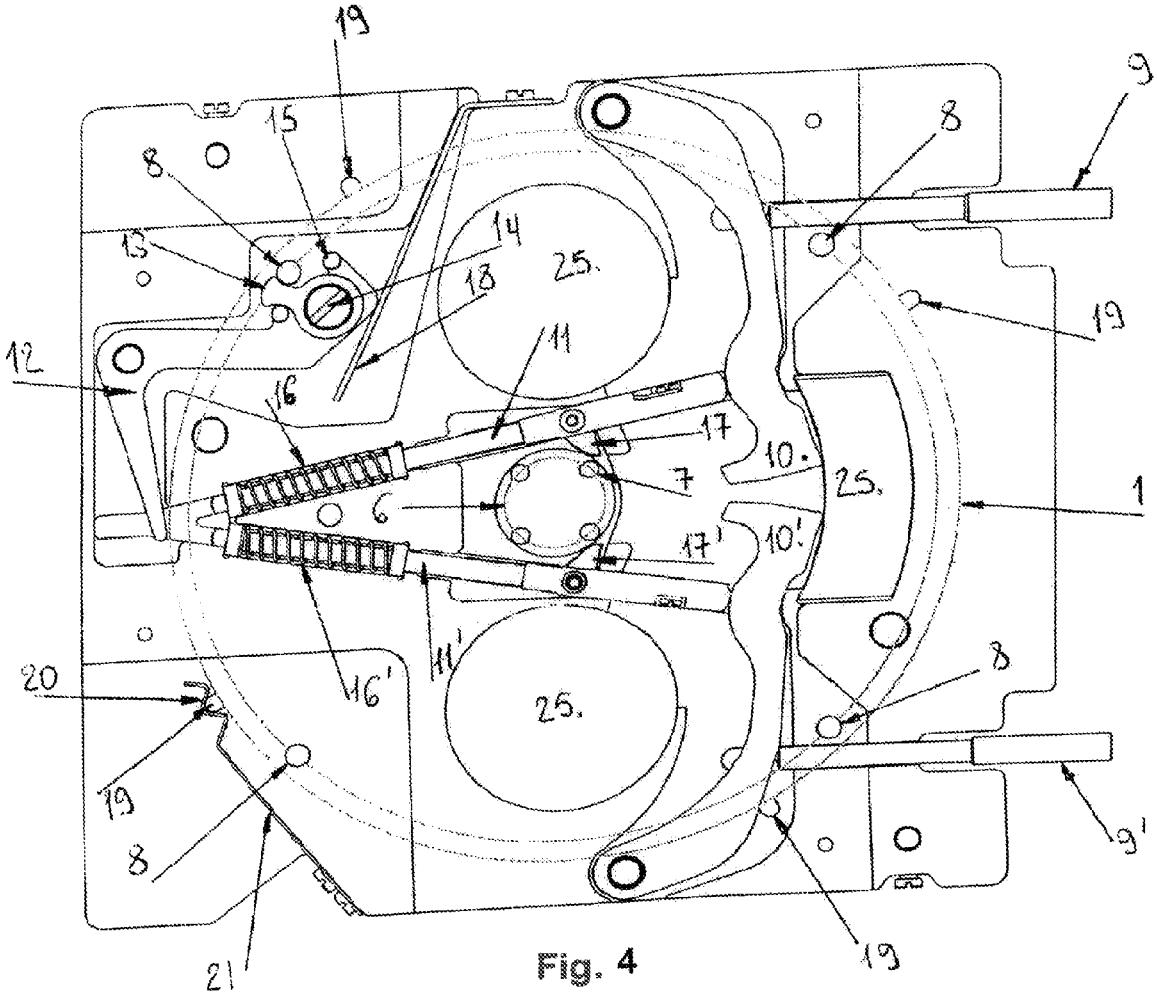
FIG. 4 is a top view of two control systems laid out on the plate in the initial position, the rotary dial being depicted in phantom lines.

The hook (17) is loosely fitted to the rod (11) about a pin (23) perpendicular to the rod (11) (FIG. 3). A spring (24) is screwed to said rod (11) in such a way that one of its ends rests on the nub of the hook (17) pushing it out to project at 90° from the rod (11). The hook (17) can thus retract on contact with one of the four driving pins (7) which means that the rod (11) does not jam when the pusher (9) is operated.

The various component parts of the control system described above and of the control system for turning the rotary dial (1) of the module in the counter clockwise direction by the action of a pusher (9') are laid out on a plate (24) which is intended to be positioned directly over the watch movement. Said plate (24) has openings (25) aligned with the openings (25) of the base dial (3) so that the four complications of the watch movement can be seen.

Figure 7:
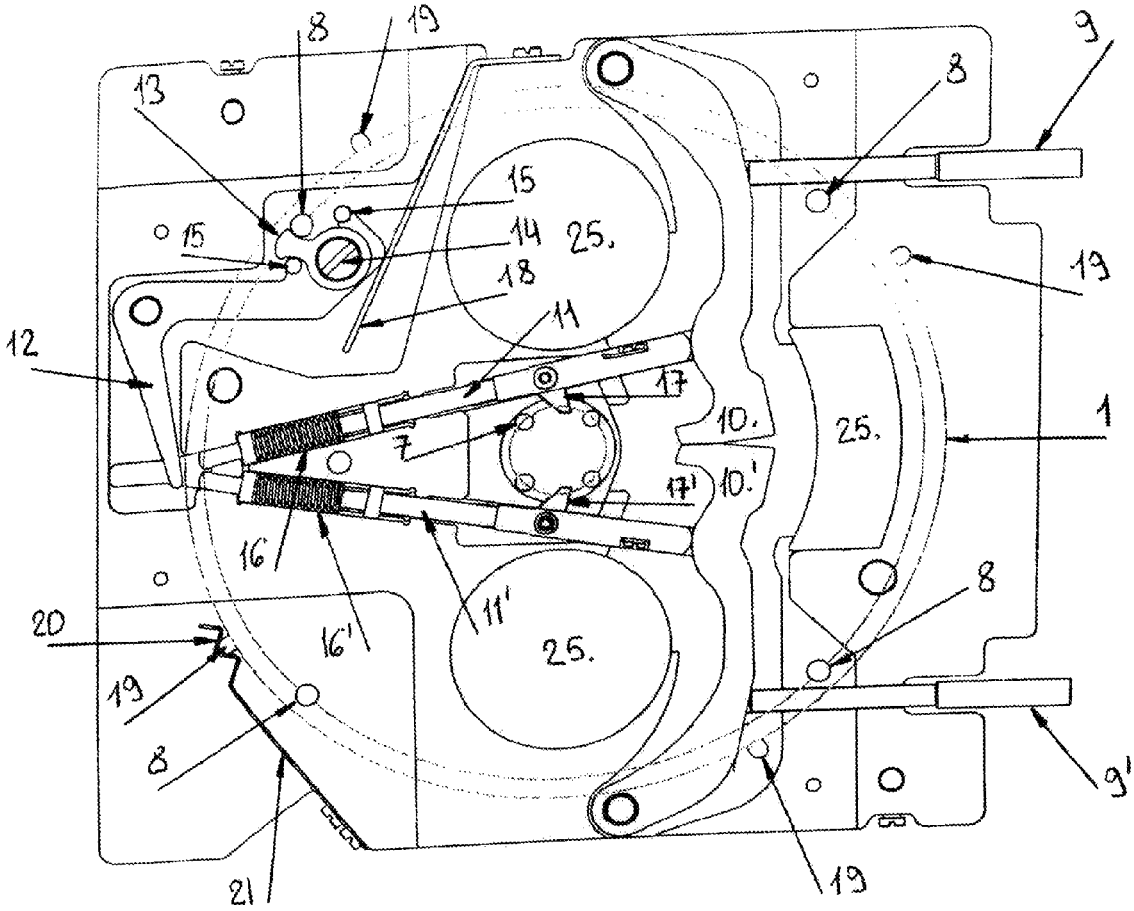
FIG. 7 is a top view of FIG. 4 when the two pushers are operated simultaneously.

The symmetrical shaping and positioning of the two transmission rockers (10, 10') allow only one pusher (9, 9') to be operated at a time, since simultaneous pressure on said pushers will immobilize both control systems (FIG. 7).

The embodiment is in no sense restrictive and consequently the number of driving and stop pins (7, 8) may be less or greater than four in order to vary the angle of rotation of the rotary dial (1) when the pusher (9) is operated. The intervals between said driving and stop pins (7, 8) do not have to be regular. In addition, designs may replace one or more complications of the watch movement.

The invention claimed is:

1. A watch module fitted to a watch movement, said module comprising a rotary dial possessing an opening, the rotary dial being mounted rotatably on a base dial (3) via an annular low-friction member (4), wherein the watch movement comprises a plurality of complications or images and the base dial comprises a corresponding plurality of base dial apertures each said base dial aperture being arranged to align with one of the complications or images of the watch movement so that said complication or image can be viewed through the rotary dial opening when the rotary dial opening aligns with the corresponding base dial aperture, and the watch module further comprises a pusher actuatable to instantaneously rotate the rotary dial to cause the rotary dial opening to jump from a position aligned with one of the base dial apertures to another position aligned with another base dial aperture in order to display another complication or image of the watch movement through said rotary dial opening.

2. The watch module as claimed in claim 1, comprising means for arresting and coupling the rotary dial to the base dial, said module being able to decouple the rotary dial from the base dial when the pusher is actuated and to drive the rotary dial when the pusher is released.

3. The watch module as claimed in claim 2, wherein the underside of the rotary dial comprises a plurality of driving pins arranged at regular or irregular intervals on a circle situated close to the center of the rotary dial, and a matching plurality of stop pins positioned on the perimeter of the rotary dial at regular or irregular intervals, the action of the pusher causing a transmission rocker to pivot and communicate a rectilinear movement to a rod until one end of the rod operates a stop rocker to stop the stop pins, and to momentarily disengage one of said stop pins, said rod comprising a return spring allowing the rod to regain a rest position when the pusher is no longer being operated, the rod bringing a hook into contact with one of the driving pins to trigger rotation of the rotary dial in a first direction until the next stop pin is stopped by the stop rocker.

4. The watch module as claimed in claim 3, comprising a second pusher that causes a second transmission rocker to pivot when the second pusher is operated, which second rocker transmits a rectilinear movement to a second rod until one end of the second rod operates the stop rocker, said second rod comprising a second return spring allowing the second rod to regain its rest position when the second pusher is no longer being operated, the second rod bringing a second hook into contact with one of the driving pins to trigger rotation of the rotary dial in the opposite direction to said first direction of rotation.

5. The watch module as claimed in claim 4, wherein the shaping and positioning of the two transmission rockers allow only one pusher to be operated at a time.

6. The watch module as claimed in claim 5, comprising a stop finger operable by the stop rocker to stop the stop pins, the stop finger being freely pivotable about a pivot pin and two pins that limit the movement of the stop finger.

7. The watch module as claimed in claim 4, wherein each hook is loosely fitted to a respective one of said rods about a pin perpendicular to said respective rod, a spring being mounted on the rod so as to rest on the nub of the hook, and push the respective hook out from the respective rod, and wherein each hook retracts on contact with a driving pin when the respective rod is operated by the respective transmission rocker.

8. The watch module as claimed in claim 4, comprising a stop finger operable by the stop rocker to stop the stop pins, the stop finger being freely pivotable about a pivot pin and two pins that limit the movement of the stop finger.

9. A watch comprising the watch module as claimed in claim 4.

10. The watch module as claimed in claim 3, comprising a stop finger operable by the stop rocker to stop the stop pins, the stop finger being freely pivotable about a pivot pin and two pins that limit the movement of the stop finger.

11. The watch module as claimed in claim 10, wherein the perimeter of the rotary dial has a plurality of humps configured to click one at a time into a housing formed in a leaf spring when one of the stop pins is stopped by the stop finger, thereby holding the rotary dial in a fixed position.

12. The watch module as claimed in claim 3 comprising equal numbers of said driving pins, said stop pins and, if employed, humps the driving pins and stop pins being in matching positions.

13. The watch module as claimed in claim 12, comprising four driving pins, four stop pins, and four humps.

14. A watch comprising the watch module as claimed in claim 12.

15. The watch module as claimed in claim 3, comprising a stop finger operable by the stop rocker to stop the stop pins, the stop finger being freely pivotable about a pivot pin and two pins that limit the movement of the stop finger.

16. A watch comprising the watch module as claimed claim 1.

17. A watch module capable of being fitted to a watch movement, the watch module comprising a rotary dial possessing an opening for displaying a complication of the watch movement or an image, wherein the rotary dial is rotatably mounted on a base dial via an annular low-friction member, the rotary dial being pivotable by the action of a pusher to display another complication or image through the opening and comprising means for arresting and coupling the rotary dial to the base dial, the watch module being able to decouple the rotary dial from the base dial when the pusher is pushed, and to drive the rotary dial when the pusher is released, wherein the underside of the rotary dial comprises a plurality of driving pins arranged at regular or irregular intervals on a circle situated close to the center of the rotary dial, and a matching plurality of stop pins positioned on the perimeter of the rotary dial at regular or irregular intervals, the action of the pusher causing a transmission rocker to pivot and communicate a rectilinear movement to a rod until one end of the rod operates a stop rocker to stop the stop pins, and to momentarily disengage one of said stop pins, said rod comprising a return spring allowing the rod to regain a rest position when the pusher is no longer being operated, the rod bringing a hook into contact with one of the driving pins to trigger rotation of the rotary dial in a first direction until the next stop pin is stopped by the stop rocker.

* * * * *